US008657699B2

(12) United States Patent
Falls

(10) Patent No.: US 8,657,699 B2
(45) **Date of Patent: *Feb. 25, 2014**

(54) GOLF ACCESSORIES FOR DETERMINING A GIMME PUTT AND METHOD OF USING THE SAME

(75) Inventor: Christopher E. Falls, Lake Bluff, IL (US)

(73) Assignee: Christopher E. Falls, Lake Bluff, IL (US)

( * ) Notice: Subject to any disclaimer, the term of this patent is extended or adjusted under 35 U.S.C. 154(b) by 20 days.

This patent is subject to a terminal disclaimer.

(21) Appl. No.: 13/208,041

(22) Filed: Aug. 11, 2011

(65) Prior Publication Data

US 2012/0077626 A1 Mar. 29, 2012

Related U.S. Application Data

(63) Continuation-in-part of application No. 12/891,985, filed on Sep. 28, 2010.

(60) Provisional application No. 61/338,173, filed on Feb. 16, 2010.

(51) Int. Cl.
*A63B 69/36* (2006.01)

(52) U.S. Cl.
USPC ..... 473/257; 473/407

(58) Field of Classification Search
USPC ..... 473/218, 219, 257, 261, 262, 265, 266, 473/268, 270, 272, 273, 407
See application file for complete search history.

(56) References Cited

U.S. PATENT DOCUMENTS

| | | | | |
|---|---|---|---|---|
| 1,098,571 | A * | 6/1914 | Haase | 403/113 |
| 3,141,675 | A * | 7/1964 | Street | 473/218 |
| 3,604,711 | A | 9/1971 | Hansburg | |
| 4,258,475 | A | 3/1981 | Buckley | |
| 4,273,329 | A | 6/1981 | Trigg et al. | |
| 4,348,815 | A * | 9/1982 | Hurt | 33/419 |
| 4,532,712 | A | 8/1985 | Vistain | |
| 4,745,689 | A * | 5/1988 | Hiltz | 33/451 |
| 4,871,175 | A * | 10/1989 | Levin et al. | 473/218 |
| 4,880,232 | A | 11/1989 | Lang | |
| 5,082,276 | A | 1/1992 | Stevens | |
| 5,403,001 | A | 4/1995 | Skorpinski | |
| 5,776,015 | A | 7/1998 | Bernhardt | |
| 5,893,805 | A * | 4/1999 | Douglass | 473/218 |
| 5,898,484 | A | 4/1999 | Harris | |
| 5,933,224 | A | 8/1999 | Hines et al. | |
| 6,102,817 | A | 8/2000 | Boswell | |
| 6,106,408 | A * | 8/2000 | Roman | 473/266 |
| 6,679,785 | B1 | 1/2004 | Richard | |
| 7,238,118 | B1 * | 7/2007 | Terrill | 473/272 |
| 7,261,640 | B1 * | 8/2007 | Baggott | 473/270 |
| 7,419,438 | B2 | 9/2008 | Koiwai | |
| 2009/0176595 | A1 * | 7/2009 | Hubley | 473/238 |

FOREIGN PATENT DOCUMENTS

EP 899535 A2 * 3/1999

* cited by examiner

*Primary Examiner* — Nini Legesse
(74) *Attorney, Agent, or Firm* — Cook Alex Ltd.

(57) ABSTRACT

A golf accessory for determining a gimme status of a golf putt in the form of a device that includes areas and/or indicia relating to at least two preselected conditions and by which a gimme status of a golf putt may be determined. Additional indicia on the device is associated with a practice putting game, and a method of playing the practice putting game also is disclosed.

15 Claims, 13 Drawing Sheets

GOLF ACCESSORIES FOR DETERMINING A GIMME PUTT AND METHOD OF USING THE SAME

CROSS-REFERENCE TO RELATED APPLICATION

This application is a continuation-in-part of U.S. patent application Ser. No. 12/891,985, filed on Sep. 28, 2010, which claims priority from U.S. Provisional Patent Application No. 61/338,173, filed on Feb. 16, 2010. The disclosures of both related applications are hereby incorporated by reference herein.

FIELD OF THE DISCLOSURE

The present disclosure relates generally to golf accessories and more particularly to novel accessories and methods for determining a gimme putt within a round of golf.

BACKGROUND

A "gimme" in the game of golf is a short putt that is conceded by a golfer's competition or playing companions because the putt is close enough to the hole that the probability of the golfer missing the shot is extremely low. When a gimme is awarded, the player can pick up the ball and add a stroke to their score without actually putting the ball into the hole. A gimme eliminates the time needed to set up for the short putt and eliminates the risk of missing the short putt. It is the player's competition or playing companions and not the player himself that may award a gimme.

Gimmes may be used in all match play format events, including professional events, where the score is kept by number of holes won, lost, and tied versus an opponent. Well known match play format events include the men's and women's United States Amateurs, and The Accenture World Match Play Championship. The U.S.G.A and Royal and Ancient Golf Club have a complete set of rules dedicated to match play golf.

Far more common than the gimme putts in official match play competition is the gimme putt in casual weekend play among friends, or social or non-sanctioned golf tournaments, such as company golf outings or fundraisers. Such social and non-sanctioned golf tournaments usually are played using a stroke play format, in which the total number of strokes per round determines the player's score.

Typically, a gimme is improper if it would yield a score below par for a particular hole, irrespective of the length of the putt, because such a score commands a reverence that must be earned. Also, when a putt is for a score of par or higher, the maximum length from the hole for awarding a gimme may vary depending on the location of the preceding shot, because the gimme also may be used to reward a good shot. The distance for a gimme may be marginally further for shots originating from off the green than shots originating from on the green. A more generous gimme distance may be granted because of the difficulty of landing a shot close to the hole when the shot originates from off the green, such as the fairway, rough or bunker, relative to when the shot is a putt originating from another spot on the green.

Gimme putts are utilized in part to reduce the amount of time it takes to play a round of golf. In a typical round of golf for a par golfer, an estimated 50% of shots are hit from the putting green and more than 25% are second or third putts within a few feet of the hole. Even if the average player takes one minute to play a single shot, it can be quickly ascertained that the time accumulation merely spent on short putts comprises a significant part of a round of golf. If an average of two members of a foursome have gimme putts on every hole the time saved would be more than a half hour of play per round. This reduces traffic around the hole, and the time savings increases capacity for a golf course, and increases game appeal for those who are concerned about spending too much time on a golf course away from family, work or other activities.

Besides the economic impetus for awarding gimme putts, there is an important social aspect to the gesture. Common courtesy dictates that opposing players or playing companions in competitive and non-competitive formats, should concede a putt if the ball is sufficiently close to the hole. Two underlying social motivations for extending this courtesy to one's playing partners, besides speeding up play, include safeguarding the enjoyment of the game for all players involved, and the duty of rewarding fellow competitors and companions for making good shots in such a difficult game.

One arbitrary gauge for this concession is use of a putter to determine when a ball is "within the leather," or within the length of the shaft below the putter handle when the putter head is placed inside the hole. For two principal reasons, this method has never achieved wide acceptance. First, the length of putters varies considerably, particularly in the last two decades with the introduction of longer putters that can extend all the way up to a golfer's chin. The resulting lack of a standard "inside the leather" length makes the equitable application of this methodology prohibitive.

Second, use of the method implies a certain unethical lack of consideration for the condition of the golf hole. If each golfer playing a golf hole on any given day puts the head of a putter inside the golf hole and pulls it against the edge of the cup to obtain a true measure of the "inside the leather" status of a golf ball, the putter shaft and head would inevitably damage the turf around the edge of the cup. Because each golfer has an inherent obligation to maintain the golf course properly, i.e., raking sand traps, replacing divots, fixing ball marks, etc., such destructive behavior could be construed as disregard for a fundamental, core value of the game.

Moreover, the enjoyment of the recreational golf environment can be fractured when a player is not awarded a gimme putt when he has a "sure thing" or after making a shot he feels deserves a show of gratuitous sportsmanship from his competitors, e.g., Scenario 1, below. If the player subsequently misses the putt he felt should have been a gimme, a resulting negative emotion from missing the "sure thing" may pervade not only the individual player, but the entire group for the remainder of the round and beyond, e.g., Scenario 2, below.

Also, the institutional integrity of the game of golf is undermined by the misapplication of gimme putts by individual golfers and groups at golf events. On an individual level, a golfer awarding gimme putts to himself at his own discretion is a common form of cheating that threatens the accuracy of the handicap system, e.g., Scenario 3, below. On a group level, the lack of uniformity of gimme determination between groups at a competitive event yields an inequitable competitive advantage for the teams with the most lenient methods, e.g., Scenario 4, below. The lack of a standardized gimme poses a threat to the handicap system and to fair competition, ultimately making the game less enjoyable for everyone involved.

Scenario 1

Charlie is engaged in a friendly $5 Nassau match with his partner and two other friends. Charlie hits a pitch shot with a lob wedge over a greenside bunker to a close pin position. The ball lands and rolls to a distance between a foot and a half and two feet from the hole. This is a fantastic shot, leaving him a par putt he is sure to make more than nine out of ten times. One of Charlie's competitors would like to concede the putt to him, but isn't sure if his partner feels the same way. The competitors are down in the match and one in particular hates to lose at anything no matter how small the bet. Charlie expects that his shot will be rewarded with a concession, but as he walks up to the hole, no word is uttered and his good will towards his competition plummets. After marking his ball and waiting a few minutes for his turn, he steps up and knocks the putt in for what turns out to be a win. Rather than feeling good about it, he feels a lingering resentment that turns into a competitive mean streak that hurts the foursome's chemistry for the rest of the round.

Scenario 2

Gary is an elderly retiree playing a par four at his local country club with his sons and his son-in-law, in a best ball foursome event, where the best score of the four players is counted for each hole. Gary has not played well all day, but the group is playing well and has a sense that their final score will be competitive if they can finish the round by parring the last three holes. On this particular hole, however, everyone except Gary has hit their tee shots into a lake on the right side of the fairway, effectively eliminating use of their score on the hole. They are all counting on Gary to come through with a par.

Gary's second shot comes to rest in the fairway sixty yards from the hole. With the pressure on, he hits a wedge shot to within a foot of the hole and his sons and son-in-law cheer him on for delivering a great shot in the clutch. As Gary approaches the ball to tap it into the hole for what seems to be a sure par, he has a sudden surge of fear about missing the putt that is related to a condition called "the yips," which is a condition that commonly plagues aging golfers during short putts. Yips is best described as muscle spasms in the wrists and arms that cause the putter head to flail and deviate drastically from the intended putting line.

Gary's fear becomes self-fulfilling, as it so often does with the "yips", and he proceeds to miss the putt. Instead of leaving the hole with a sense of pride for having hit what would have been a wonderful, penultimate shot, he leaves with a sense of disaster having let the group down and asking himself, "what's wrong with me" for missing what could be described as a sure thing. He is robbed of what would have been his one moment of pleasure, and is left with low self-esteem that sours the rest of his day.

The negative mental and emotional outcomes of both preceding scenarios could have been eliminated if the uncertainty could have been removed from the group dynamic. In the first scenario, the uncertainty stemmed from confusion between Charlie's competitors who were not sure whether each other felt comfortable conceding the putt to Charlie. In the second scenario, the uncertainty was the result of the best ball format where the foursome is playing as a team versus other foursomes and so the team is unsure if it's fair to award their own team member a gimme putt. Both scenarios led not only to a mildly traumatic event for the person who attempted the putt, but also to a longer sense of stress experienced by each foursome for the rest of the respective round. Given that golf rounds can be long, tedious and expensive, it is a shame that the gimme status of a putt, whether subsequently missed or made, can contribute to making the game more gruesome than pleasurable.

Scenario 3

John takes a golf vacation to his mother-in-law's winter home in Florida where he enjoys the wonderful golf course with his relatives. He hasn't seen his cousin for a few years and is impressed when his cousin tells him he has lowered his handicap from a ten to a four. John is eager to witness his cousin's new level of play and the two head out on the course for an early morning round.

John is immediately impressed after his cousin pars the first hole in routine fashion. On the second hole, his cousin misses the green long on a second shot and has to get up and down to save par. After hitting a good pitch shot to a position five feet from the hole, rather than marking his ball and lining up his putt for par, his cousin casually steps up to his ball with an open stance and tries to putt it in the hole. The ball is on a line to miss the hole but before that outcome can be realized, his cousin reaches over and redirects the ball into the hole. Before he even struck the putt, his cousin had already conceded the putt to himself. Because it is a casual game of golf and John does not want to introduce a level of contentiousness into their relationship, he decides it's not worth calling his cousin out on it.

While his cousin's game has certainly improved since they last played together, John notices his cousin exhibiting this same self-awarding behavior with all relatively short putts throughout the round. Even when his cousin makes the short putts he casually approaches, they are not as meaningful because he never intends to count them if he misses. His cousin finishes the round and claims to shoot a 75, but John wonders what the actual score would be if his cousin had not automatically awarded himself a gimme on all relatively short putts and instead had putted out on every hole. John's cousin boasts about his score throughout the rest of the day and John suffers from a new disdain for his cousin's lack of integrity, for his own unwillingness to challenge his cousin, and for how this adversely affected his own game and sense of well being on the course.

Scenario 4

The next day John, his cousin and his cousin's two sons play in a best ball foursome event at the club. John notices that not only his cousin is awarding himself extended gimme putts of three to four feet, but the sons are as well. The foursome wins the event by two shots, but John is uneasy about the victory because he witnessed several competitors on adjacent holes that attempted shorter putts than those that his cousin and the sons conceded to themselves. John fears damaging his cousin's reputation by explaining the situation to the head pro, but the group clearly cheated and John knows the win is meritless.

More so than other sports, golf requires individual integrity through self-regulation to preserve its competitive validity. Putting ability substantially impacts overall score and handicap. The integrity of the scores upon which most handicaps are based is brought into question when golfers are not held to a consistent standard for short putts, This is detrimental in an obvious way, where a player carries a lower handicap than he should and therefore becomes a competitive liability when he plays with a partner in an event where every putt has to be holed out, and in a less obvious way where an interpersonal relationship suffers, because the character of one of the participants is brought into question. The inappropriate self-determination of a gimme or award of a gimme to a playing partner in a team event is arguably the most common form of cheating in golf, is largely unenforced, and many players, including the perpetrators themselves, are paying a high price for it. These unfortunate circumstances result directly from the lack of meaningful standards for gimme putts.

SUMMARY

The present disclosure is directed to golf accessories for determining a gimme putt within a golf game, and methods of using the devices, as set forth in or otherwise apparent from the description and drawings that follow, and that which is learned by the practice of the subject matter disclosed herein.

Currently, there is not a standard distance from the hole for allowing a gimme. Instead, the distance often varies from player to player and hole to hole. Generally, an appropriate gimme distance should be defined by a combination of the probability of making a putt from a particular distance ("putt conversion probability") and the origination of the shot ("shot origination"). Consideration for awarding a gimme putt also may be based on the likely score achieved ("score attainment"), as well as whether the putt is played in a Scramble or Best Ball event ("event format"). For instance, even formats, such as a "Scramble" versus "Best Ball", may effect variations in appropriate gimme distances. In a Scramble event, where all the players in a group hit from the same location, the shot with the best outcome is selected, and all the players then hit from this subsequent location, it may be more appropriate to award a marginally longer gimme distance than in an event where everyone is playing their own ball to the hole, i.e., Best Ball. Since the Scramble format calls for multiple attempts from the same location with one score submitted for the group on each hole, the group would have multiple attempts at each short putt, and the probability of missing these putts would be reduced.

Studies suggest that the greatest distance from the hole for converting a putt 90% of the time is between two and two and a half feet from the hole. Additionally, other research suggests that an ideal putt of any length and under any condition is struck with enough force to travel seventeen inches past the hole because such force gives the ball the best chance to roll to the hole on its intended line without adverse effects from imperfections on the green and without too much risk of rolling so far by the hole to make the subsequent putt too difficult.

With these considerations, a putt originating from a shot from off the green should be awarded a longer gimme distance, such as between two and two and a half feet. Conversely, shots originating from the green, which are easier to hit close to the hole than shots from off the green, should require a gimme distance closer to the hole but with some acceptable margin to be added to the seventeen inches. Ultimately, for subsequent putts, a higher putt conversion probability should trump the distance a putt travels past the hole. For example, when putts are left short of the hole, but still have a high conversion probability, they should still be considered gimmes.

It may be appropriate consideration that a putt for a score of triple bogey, three over par, or higher be awarded a longer gimme distance, for example, between two and two and a half feet, because it generally is non-competitive and may speed play. Conversely, putts for par or bogey, level or one over par respectively, are likely to be competitive and may be considered to require a gimme distance closer to the hole but with some acceptable margin to be added to the seventeen inches. Also, a putt in a Scramble event, sometimes called "Captain's Choice", where all players in a group attempt shots from the same location, and so the probability of converting short putts is higher, a longer gimme distance, such as between two and two and a half feet, may be appropriate. Conversely, putts in a Best Ball event, where all players play their own ball to the hole, should require a gimme distance closer to the hole but with some acceptable margin to be added to the seventeen inches.

While there are a number of benefits and advantages for allowing, and even encouraging, gimme putts in the game of golf, the lack of standardization and an appropriate determination source has created myopia around the term that threatens both the integrity and enjoyment of the game. In this sense, the game lacks a standardized means of determining when a gimme is proper ("gimme status").

The disclosure includes an elongated device having areas and/or bearing indicia relating to at least two preselected conditions and by which a gimme status of a putt is determined. The device is used in a method of checking a distance between a golf ball and a hole when the golf ball is on a putting green to determine the gimme status of the golf putt that may lie close enough to the golf hole such that there is a low probability the golfer will miss the putt and a high probability the player's companions would concede the putt prior to the player addressing the putt. The device also is useful in applying a gimme as a reward for a good shot and as such makes a distinction of this status based on the origin of the previous shot, or based on event format and can be configured to make distinctions based on these conditions.

The disclosure provides a device and a standard method for determining gimme status when using the device under specific conditions. Use of the device may increase the enjoyment in golf rounds and decrease social awkwardness that accompanies discretionary gimme status determination without a standardized device. This may be accomplished by removing the devastating impact of the "yips" and by eliminating the current discretionary nature of awarding and receiving gimmes. It also is desirable generally to preserve the institutional integrity of the game, and the handicap system, specifically. This is accomplished, in part, by establishing an equitable standard for awarding gimmes. The device attempts to achieve construction simplicity to permit cost effective widespread use and adoption as an industry wide standard. The device also advantageously may be customizable for golf organizations and country clubs that would like to display their colors and/or logos on the device and for sponsors that would like to do the same for advertising purposes.

In a first aspect, the disclosure provides a golf accessory that includes an elongated device having areas relating to at least two preselected conditions by which a gimme status of a putt is determined. In a second aspect, the disclosure provides a golf accessory that includes an elongated device bearing indicia relating to at least two preselected conditions by which a gimme status of a putt is determined. It will be appreciated that the device may use both areas and indicia, or that indicia may define areas relating to at least two preselected conditions. In a further aspect, the disclosure provides a method of determining a gimme status of a golf putt by using a device having areas relating to at least two preselected conditions that includes the steps of placing the device in an elongated position adjacent a golf hole on a golf green and extending the device to lie in a path adjacent a golf ball that is in a position to be putted on the golf green, considering the status of the ball, which may be determined based upon the prior stroke played that resulted in the position of the golf ball, the score to be attained by converting the putt, or an event format, such as Scramble or Best Ball, to select which of the at least two preselected conditions should be applied to the golf ball that is in the position to be putted, and determining whether the golf ball is in a position that warrants application of at least one of the preselected conditions that would render the putt conceded.

DETAILED DESCRIPTION

Figure 1:
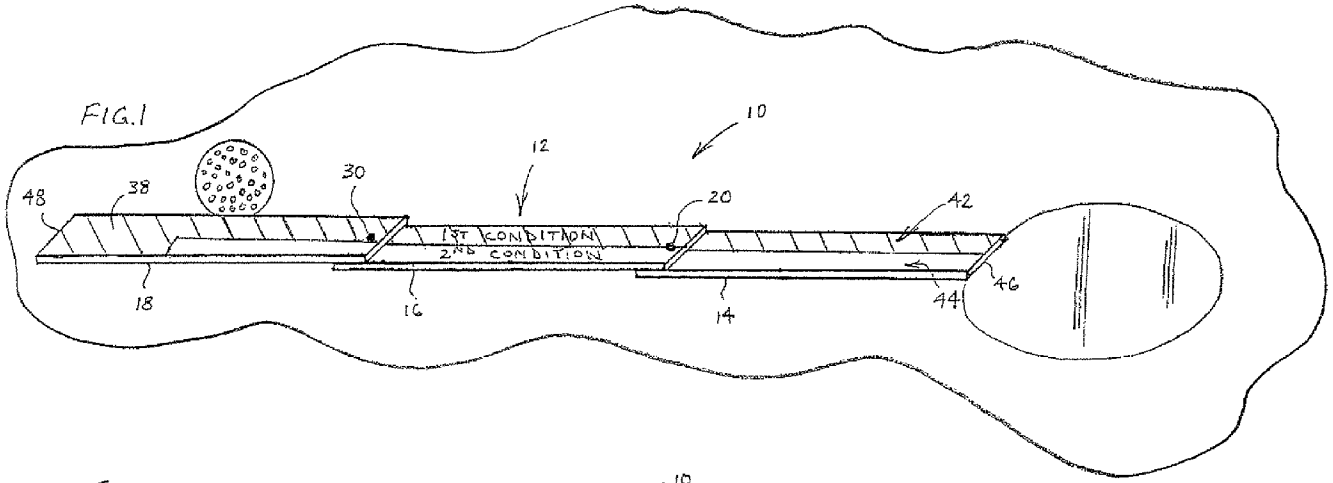
FIG. 1 is a top perspective view of an example device with three portions shown in an unfolded position.
Figure 2:
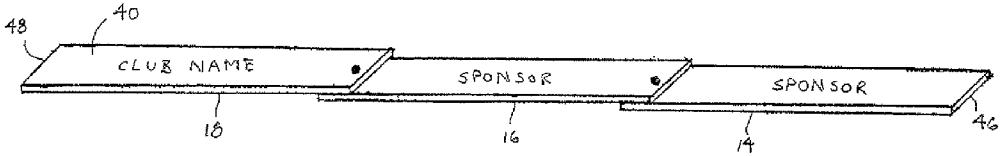
FIG. 2 is a bottom perspective view of the device of FIG. 1 in the unfolded position.
Figure 3:
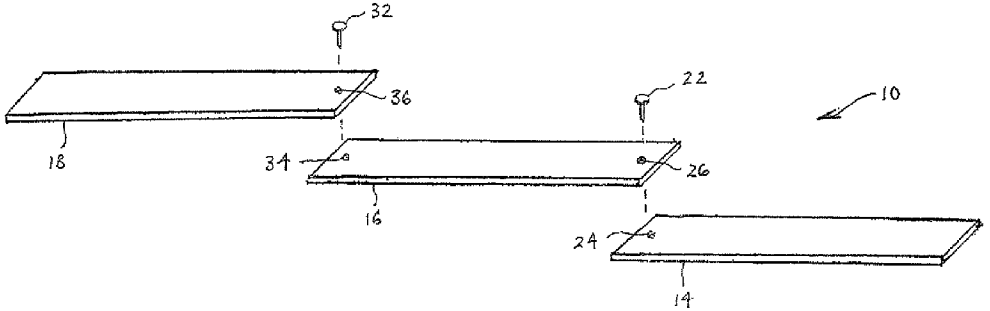
FIG. 3 is a top perspective exploded view of the device of FIG. 1 in the unfolded position and in a simplified view.
Figure 4:
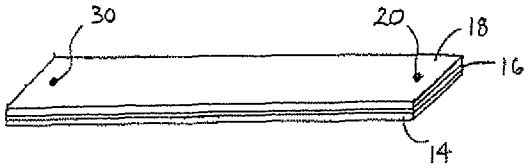
FIG. 4 is a top perspective view of the device of FIG. 1 in a folded position.

An example golf accessory for determining a gimme status of a putt is illustrated in FIGS. 1-4. A device 10 includes connected first, second and third portions 14, 16 and 18. The device 10 is foldable, with the portions 14 and 16 being pivotally connected at pivotal connection 20, and the portions 16 and 18 being pivotally connected at pivotal connection 30. The pivotal connection 20 includes a rivet 22 through a hole 24 in the first portion 14 and a hole 26 in the second portion 16. The pivotal connection 30 includes a rivet 32 through a hole 34 in the second portion 16 and a hole 36 in the third portion 18. The portions 14 and 16 and the portions 16 and 18 are selectably extendable to an open position about pivotal connections 20 and 30, respectively, as shown in FIGS. 1-3. In the unfolded or extended, open position, the device 10 preferably measures approximately 27 inches long, 1½ inches wide, and 1/10 of an inch thick, but the dimensions may be varied to accompany differing standards for gimme distance and differing methods of construction. In the folded or retracted, closed position, as shown in FIG. 4, the device 10 preferably measures approximately 8½ inches long, 1½ inches wide, and 3/10 of an inch thick. It will be understood that when referring to any device within the present disclosure that is foldable, a reference to the device being unfolded is similar to referring to the device being extended and a reference to the device being folded is similar to referring to the device being retracted.

In this example, each of the portions 14, 16 and 18 of the device 10 preferably is constructed of substantially flat and relatively rigid material, such as plastic, wood, metal or the like, with the combined portions presenting a first side 38 and an opposed second side 40. However, it will be appreciated that the device need not be substantially flat or relatively rigid.

In the present example shown in FIGS. 1-4, the first side 38 includes indicia 12 that identifies two areas relating to preselected conditions for determining a gimme status of a putt. For instance, there is a first area defined by a first section 42 that has a length that is greater than the length of a second area that is defined by a second section 44. In this sense, the first area or section 42 would be for determining gimme status of golf putts where the preceding shot originated from on the green, such as successive putts, and the second area or section 44 would be for determining gimme status of putts where the preceding shot originated from off the green. The two areas, here shown as sections 42 and 44, may be differentiated in many ways. For example, the first section 42 and the second section 44 can differentiate by score achieved or by event format, they can be different colors, or each can have distinct graphic patterns. The longest area to be used in making a gimme determination preferably should not exceed 35 inches.

The two areas, sections 42 and 44, also may include text intended to differentiate them and to describe distinct conditions for awarding a gimme putt. In this example, because the section 44 is shorter, the indicia 12 on the section 44 may read "Second, Third, or Fourth Putts", "Putts For Par, Bogey or Double Bogey", or "Best Ball", while on the longer section 42 it may read "Shots From Off The Green, Except Birdie And Eagle Putts", "Putts for Triple Bogey Or Higher", or "Scramble". Or there could be text only in one of the areas that explains the use of both areas or explains the use of one area and leaves by implication the use of the other area for another gimme determining status. In this example, the first area, section 42, is used to determine the gimme status of any shot struck close to the hole from off the green, and the second area, section 44, is used to determine gimme status of any putt struck close to the hole from on the green. The first side 38 could include other information or ornamentation than the gimme status indicia 12, if desired. Additionally, the opposed second side 40 may include other information or ornamentation, such as the logo of a particular golf accessories company, a golf course, a sponsor for a golf event, or other appropriate text or graphics as desired.

The section 42 and the section 44, and portions 14, 16, and 18 also may be of varying lengths, depending on the standard used for determining a gimme distance. In this example, the first area or section 42 extends from a first end 46 to second end 48, and therefore has a length equal to device 10 in the fully opened, unfolded position, for instance, approximately 27 inches long. The second area or section 44 may extend from the same first end 46 toward the end 48, but be shorter, such as approximately 23 inches long, or could include indicia that extends from a distal end of the first section to further distal point along the portions, or to the end of the third portion 18. It will be appreciated that these lengths are preselected, and different preselected lengths could be used or, as will be described below, it may be advantageous for the device to be configured to provide more than one set of selected lengths for the areas, such as are defined by the sections in this example.

For any golf ball appearing to lie close enough to a hole to warrant consideration, a user may undertake a method of determining a gimme status of a golf putt by using the device 10, such as by extending the device 10 and placing it adjacent the golf hole, such as by placing an end at an edge of the hole that is closest to the ball. In this example, the device 10 would be extended to the open, unfolded position by ensuring portions 14, 16, and 18 are fully extended along a common axis. When placing the device 10 adjacent the hole, the user places the first end 46 containing the origin of both of the designated areas or sections 42 and 44, at an edge of the hole that is closest to the ball. Depending on the nature of the shot leading up to where the golf ball rests, a putt or a shot from off the green, the score to be attained by holing the putt, par, bogey, double bogey, triple bogey or higher, or the event format, Scramble or Best Ball, an objective gimme determination is made by viewing the areas and/or indicia 12 to see whether or not the ball is located within the length of the appropriate respective first area, first section 42, or second area, second section 44. Any additional indicia 12 may help to instruct or inform the user or may be applied for other purposes.

It will be appreciated that the device 10 may be constructed so as to account for positioning relative to the hole other than at the closest edge of the hole, however, this configuration is preferred to help minimize potential damage to the hole or turf around the hole, and to be able to be employed regardless of whether the flagstick is in the hole or has been removed. Also, it will be appreciated that the above method of determining a gimme status of a golf putt may be utilized with any of the example devices disclosed herein.

Figure 6:
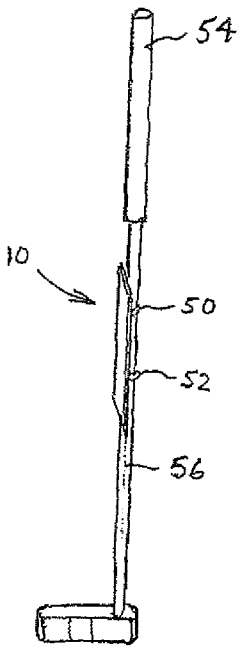
FIG. 6 is a top perspective view of the device of FIG. 5 shown attached to the shaft of a golf club.
Figure 5:
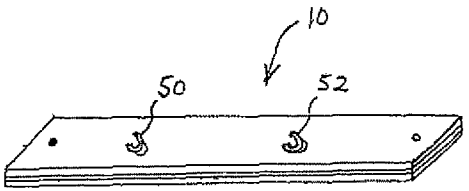
FIG. 5 is a top perspective view of the device of FIG. 1 in the folded position and having optional retaining clips.

Further additions may be made to the various embodiments. For example, FIG. 5 is the embodiment shown in FIGS. 1-4, but includes optional clips 50 and 52. The clips 50 and 52 are usable to releasably attach the device 10 to another object, such as a golf cart, golf bag, or, as shown in FIG. 6, a golf club 54, such as by connection to the shaft 56. It can be appreciated that other embodiments of the invention may incorporate releasable fasteners such as the clips 50 and 52 to attach the device to various objects for temporary stowage and/or convenient carrying of the device.

Figure 7A:
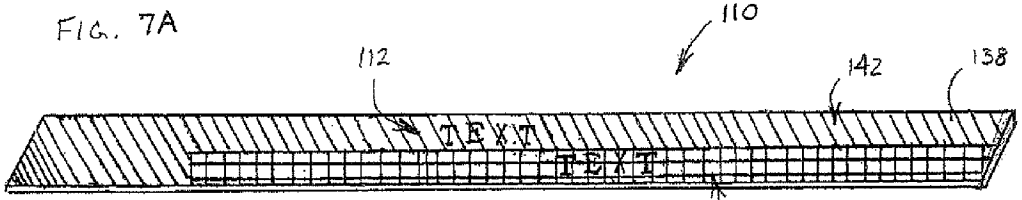
FIG. 7A is a top perspective view of another example device, having a single elongated portion.
Figure 7B:
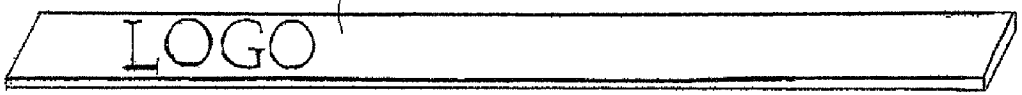
FIG. 7B is a bottom perspective of view of the device of FIG. 7A.

A further example of a golf accessory for determining a gimme status of a golf putt is shown in FIGS. 7A and 7B. This example is an elongated device 110 having areas and/or indicia 112 on one side relating to at least two preselected conditions and by which a gimme status of a golf putt may be determined. The areas may be included within indicia 112 used to designate the areas, such as by defining sections 142 and 144 on a first side 138. The areas optionally include text to describe distinct conditions for awarding a gimme putt. As with the prior example, and as could be implemented with the other examples in this disclosure, other information or ornamentation may be included and/or may be displayed on an opposed side 140.

Figure 8A:
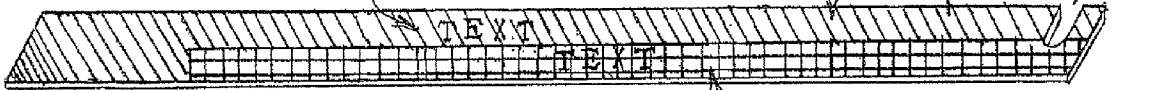
FIG. 8A is a top perspective view of another example device, having a single elongated portion but that includes a notch proximate one end.
Figure 8B:
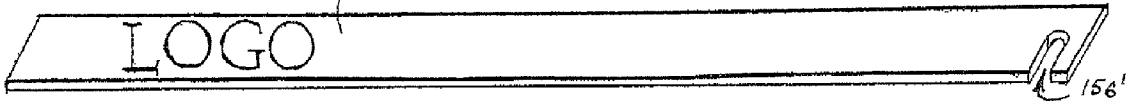
FIG. 8B is a bottom perspective of view of the device of FIG. 8A.

A variation of the example shown in FIGS. 7A and 7B is illustrated in FIGS. 8A and 8B. In this further example of a golf accessory for determining a gimme status of a golf putt, an elongated device 110' has areas and/or indicia 112' on one side relating to at least two preselected conditions and by which a gimme status of a golf putt may be determined. In this example, the indicia 112' is used to designate areas, such as sections 142' and 144' on a first side 138'. The areas optionally include text to describe distinct conditions for awarding a gimme putt, and other information or ornamentation may be included and/or may be displayed on an opposed side 140'. This example differs in that a notch 156' may be located proximate an end from which both of the areas, sections 142' and 144', extend to permit placement around the pin or flagstick to assist in determining a gimme status of a golf putt. This example may include extra length to accommodate the need to engage the flagstick as opposed to having the end of the device placed at the edge of a golf hole. Also, it can be appreciated that the notch 156' may be incorporated into other example embodiments for assisting in determining gimme status of a golf putt.

Figure 9:
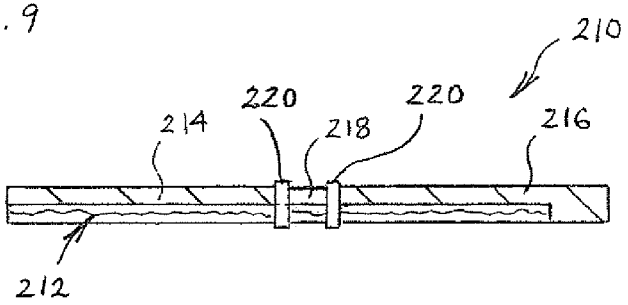
FIG. 9 is a top view of an example foldable device having two portions connected by a hinge assembly with the device shown in an unfolded position.
Figure 11:
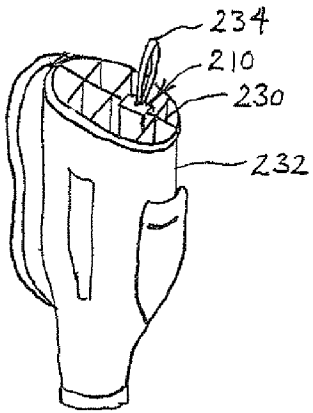
FIG. 11 is a top perspective view of the device in FIG. 9 positioned over a club partition in a golf bag.
Figure 10:
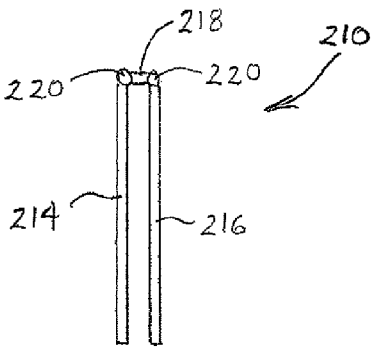
FIG. 10 is a side view of the device in FIG. 9 in a folded position.

Another example of a golf accessory for determining a gimme status of a golf putt is shown in FIGS. 9-11. A foldable device 210 has a first portion 214 that is connected to a second portion 216 by a third portion 218 via hinges 220. The third portion 218 is wide enough to allow the device 210 to be folded around and hang from a club partition in a golf bag, or other convenient location. FIG. 9 shows the device 210 in an unfolded, open position, as the portions 214, 216 and 218 are fully extended and would include areas and/or bear indicia 212 relating to at least two preselected conditions by which a gimme status of a golf putt may be determined. FIG. 10 shows that by pivoting the respective first portion 214 and second portion 216 relative to the third portion 218, the device 210 may be moved to a folded or retracted, closed position. FIG. 11 shows the device 210 in the closed position and hanging from a club partition 230 of a golf bag 232. A lanyard strap 234 may be attached to the device 210 to allow easy removal from the golf bag 232, carrying, etc. It will be appreciated that the lanyard strap 234 may be incorporated into others of the example embodiments disclosed herein, as well.

Figure 12:
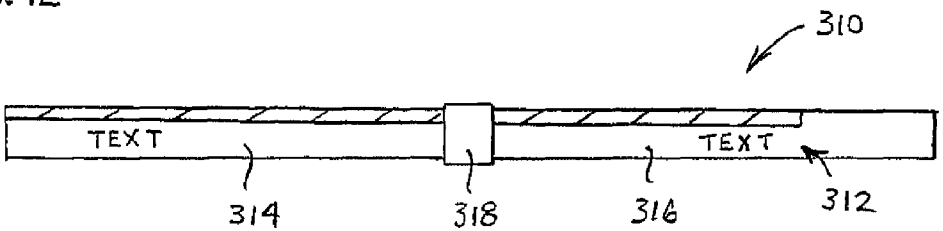
FIG. 12 is a top view of another example foldable device having two portions connected by a hinge assembly with the device shown in an unfolded, extended position.
Figure 14:
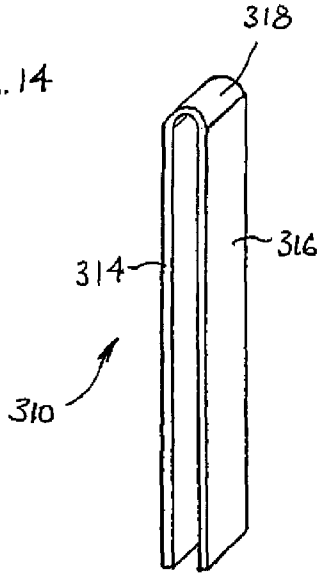
FIG. 14 is a further perspective view of the device of FIG. 12 shown in a folded position and in a simplified view.
Figure 13:
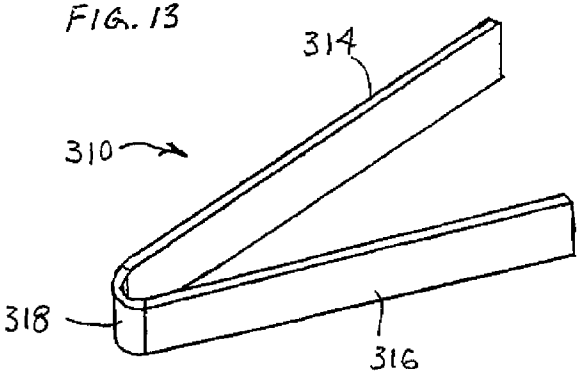
FIG. 13 is a further perspective view of the device of FIG. 12 shown in a partially unfolded position and in a simplified view.

Still another example of a golf accessory for determining a gimme status of a golf putt is shown in FIGS. 12-14. A device 310 has a first portion 314 and a second portion 316 that have areas and/or bear some indicia 312 relating to at least two preselected conditions for a gimme status determination on one side. The portions 314 and 316 are connected by a rubber-coated metal wire hinge 318. The device 310 could bear additional information or ornamentation on the first side or on an opposed second side. The hinge 318 contains rubber-coated bendable wires that selectively maintain the device 310 in an unfolded or extended, open position or in a folded or retracted, closed position. The device 310 is shown fully extended in FIG. 12, and in simplified views without the areas or indicia being partially folded in FIG. 13, and pivoted or folded to a closed position in FIG. 14.

Figure 16:
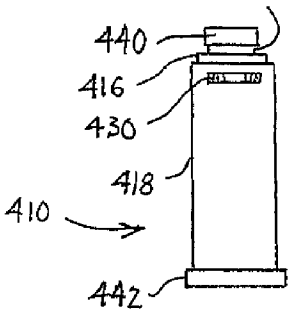
FIG. 16 is a top view of the device of FIG. 15 in a retracted position.
Figure 15:
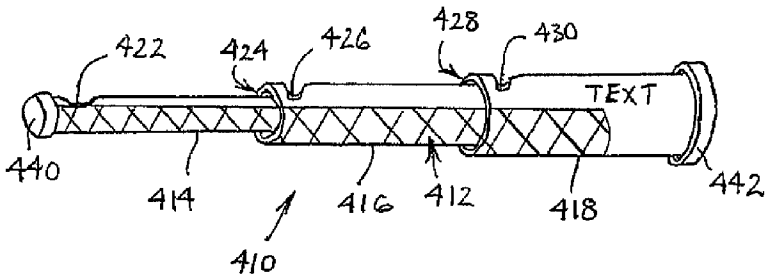
FIG. 15 is a top perspective view of a further example device, having generally cylindrical telescoping portions in an extended position.

A further example of a golf accessory for determining a gimme status of a golf putt is shown in FIGS. 15-16, in a telescoping device 410 that includes connected hollow, cylindrical first, second and third portions 414, 416, and 418 having incrementally larger diameters. On a first visible surface, the three telescopically connected portions 414, 416 and 418 have areas and/or bear indicia 412 relating to at least two preselected conditions for determining the gimme status of a golf putt, and the portions could along the remainder of the cylindrical surfaces bear other information or ornamentation. FIG. 15 shows the device 410 in an open position with the cylindrical portions 414, 416, and 418 fully extended. FIG. 16 shows the device 410 in a retracted, closed position. The locking mechanism in the example device 410 is configured to releasably lock the device 410 in the extended or retracted position by including on the first portion 414 a first lock indentation 422 that is located near a distal end of the first portion 414 and a second lock indentation 424 (not shown) that is located near a proximal end of the first portion 414, including on the second portion 416 a first indentation 426 that is located near a distal end of the second portion 416 and a second lock indentation 428 (not shown) that is located near a proximal end of the second portion 416, and including on the third portion 418 a first indentation 430 that is located near a distal end of the third portion 418.

It will be appreciated that when the device 410 is in the fully extended position shown in FIG. 15, the well of the second indentation 424 on the outside of the first portion 414 releasably engages the projection of the first indentation 426 on the inside of the second portion 416, while the well of the second indentation 428 on the outside of the second portion 416 releasably engages the projection of the first indentation 430 on the inside of the third portion 418.

Somewhat similarly, when the device 410 is in the fully retracted position shown in FIG. 16, the well of the first indentation 422 (not shown) on the outside of the first portion 414 releasably engages the projection of the first indentation 426 (not shown) on the inside of the second portion 416, while the well of the first indentation 426 (not shown) on the outside of the second portion 416 releasably engages the projection of the first indentation 430 on the inside of the third portion 418.

In this sense, the device 410 may be selectively moved between an extended position in FIG. 15 and a retracted position in FIG. 16 by pulling or pushing on the portion 414 or a cap 440 at a first end of the device 410 while holding the third portion 418 or a cap 442 at the opposed end of the device 410, so as to cause the projections formed by the indentations to engage or disengage from the wells formed by the other respective indentations.

The cap 440 also closes the first portion 414 at the first end of the device 410 and the cap 442 closes the opposed or second end of the device 410. The caps 440 and 442 prevent dirt and debris from entering the three cylindrical portions 414, 416 and 418. Each of the portions 414, 416 and 418 may be constructed of relatively rigid material, such as metal, plastic or the like. The caps 440 and 442 may be constructed of metal, plastic, rubber or other suitable materials, and may be connected to the respective first and third portions 414 and 418 by various methods, such as by use of adhesives, threaded engagement, press fit or other suitable methods of connection. However, it will be appreciated that the device 410 could be made without the caps 440 and 442, and a user could manipulate the cylindrical portions 414, 416 and 418 by pushing or pulling on them directly.

Figure 17:
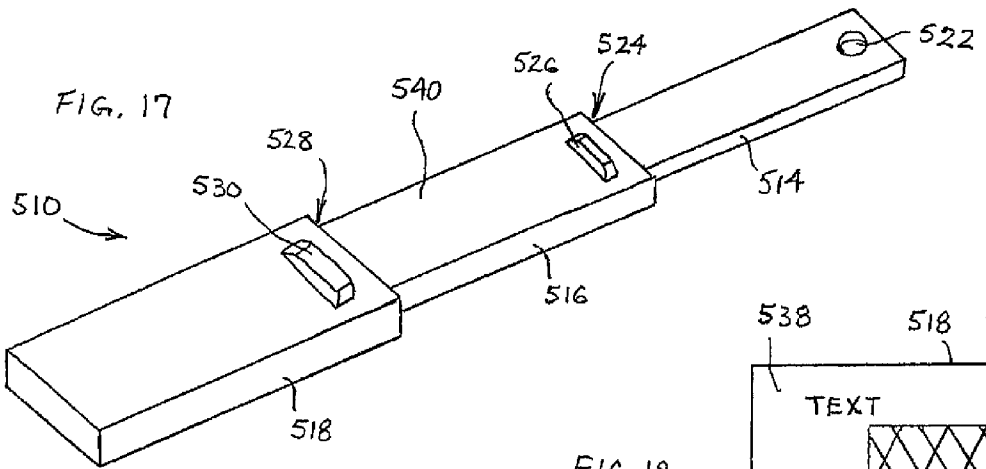
FIG. 17 is a bottom perspective view of a further example device, having telescoping portions in an extended position.
Figure 18:
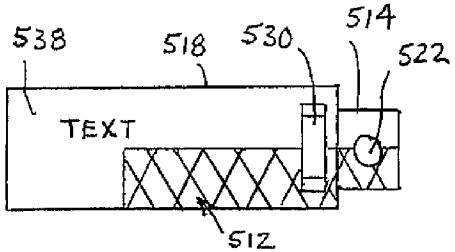
FIG. 18 is a top view of the device of FIG. 17 in a retracted position.

Another example of a golf accessory for determining a gimme status of a golf putt is shown in FIGS. 17-18, in a telescoping device 510 that includes generally flat first, second and third portions 514, 516, and 518 of incrementally larger size. The three telescopically connected portions 514, 516 and 518 on a top surface 538 have areas and bear indicia 512 relating to at least two preselected conditions for determining the gimme status of a golf putt, while on a lower surface the portions may include further graphics or text for advertising or other purposes, as desired.

As shown in FIG. 17 from a bottom perspective view of the device 510 in an open, extended position, the first portion 514 is a solid flat body having an optional gripping configuration, such as hole 522, near a distal end, and a projection 524 (not shown) along a bottom surface 540 near a proximal end. The second portion 516 is essentially configured as a rectangular tube that slidingly receives the first portion 514, and includes a projection 526 along a bottom wall near a distal end that includes a well on the inside of the bottom wall to releasably engage the projection 524 on the first portion 514. The second portion 516 also includes a projection 528 (not shown) on the bottom wall near a proximal end that includes a well on the inside of the bottom wall to releasably engage the projection 524 when in a retracted position. The third portion 518 is essentially configured as a progressively larger rectangular tube that slidingly receives the second portion 516, and includes a projection 530 along a bottom wall near a distal end that includes a well on the inside of the bottom wall to releasably engage the projection 528 when in an extended position, as shown in FIG. 17, and alternatively to releasably engage the projection 526 (not shown) when in a retracted position, as shown in FIG. 18. In this sense, the device 510 may be selectively moved between an extended position in FIG. 17 and a retracted position in FIG. 18 by using a finger to pull or push on a the first portion 514 at the hole 522 while grasping the third portion 518.

The hole 522 may be incorporated into a carrying or stowage configuration, such as by connection to a strap, as shown with the example in FIG. 11, and grasping convenience could be provided by a configuration other than the hole 522, such as by a raised ribbed profile or the like proximate the distal end of the first portion 514. By including the projections on bottom walls of the device 510, the top surface 538 of the device may have a flat configuration that provides ample surface area to include the areas and/or indicia 512 relating to at least two preselected conditions for use in determining a gimme status of a golf putt, or other desired information or ornamentation, while still further information or ornamentation may be provided on the bottom surface 540. It will be appreciated that each of the portions 514, 516 and 518 may be constructed of relatively rigid material, such as metal, plastic or the like.

Figure 19:
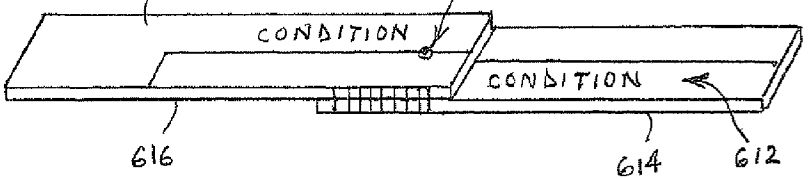
FIG. 19 is a top perspective view of another example foldable device having two portions connected by a foldable hinge, in an unfolded position.
Figure 20:
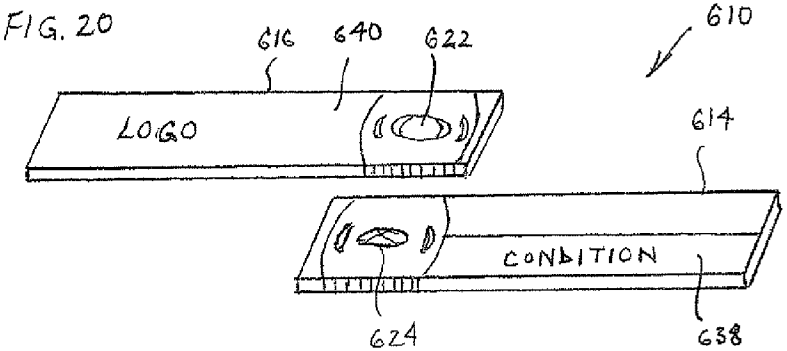
FIG. 20 is a top perspective view of the mating underside of the second portion and the top side of the first portion of the device of FIG. 19.
Figure 21:
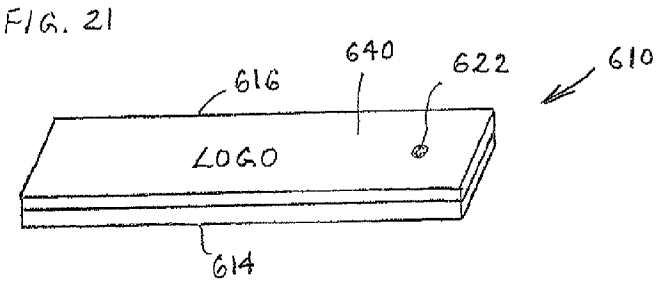
FIG. 21 is a bottom perspective view of the device of FIG. 19 in the folded position.

Another example of a golf accessory for determining a gimme status of a golf putt is shown in FIGS. 19-21. The device 610 is a folding structure having first and second portions 614 and 616 that are pivotally connected by a folding hinge 620. The folding hinge 620 has a desired amount of operative friction or detent engagement to allow the portions 614 and 616 to be selectively unfolded or extended and locked in an open position, as shown in FIG. 19, and to be selectively folded or retracted and locked in a closed position, as shown from the bottom side in FIG. 21. As with the other examples, the device 610 includes areas and/or indicia 612 on a top side 638 relating to at least two preselected conditions for gimme status determination of a golf putt, and may include other information or ornamentation on the top side 638 or on a bottom side 640, as desired.

In FIG. 20, the device 610 is shown with the second portion 616 flipped over, so as to show the bottom side of the second portion 616 containing an indentation 622 of the folding hinge 620, while showing the top side of the first portion 614 and a protrusion 624 of the hinge 620 that is received in the indentation 622. It will be appreciated that many folding hinges may be incorporated into this or other example embodiments, such as the folding hinge described in U.S. Pat. No. 2,663,940, incorporated by reference herein. Also the portions 614 and 616 may be constructed of any relatively rigid material, such as plastic, wood or metal, and the folding hinge may be constructed of metal or plastic elements.

Figure 23:
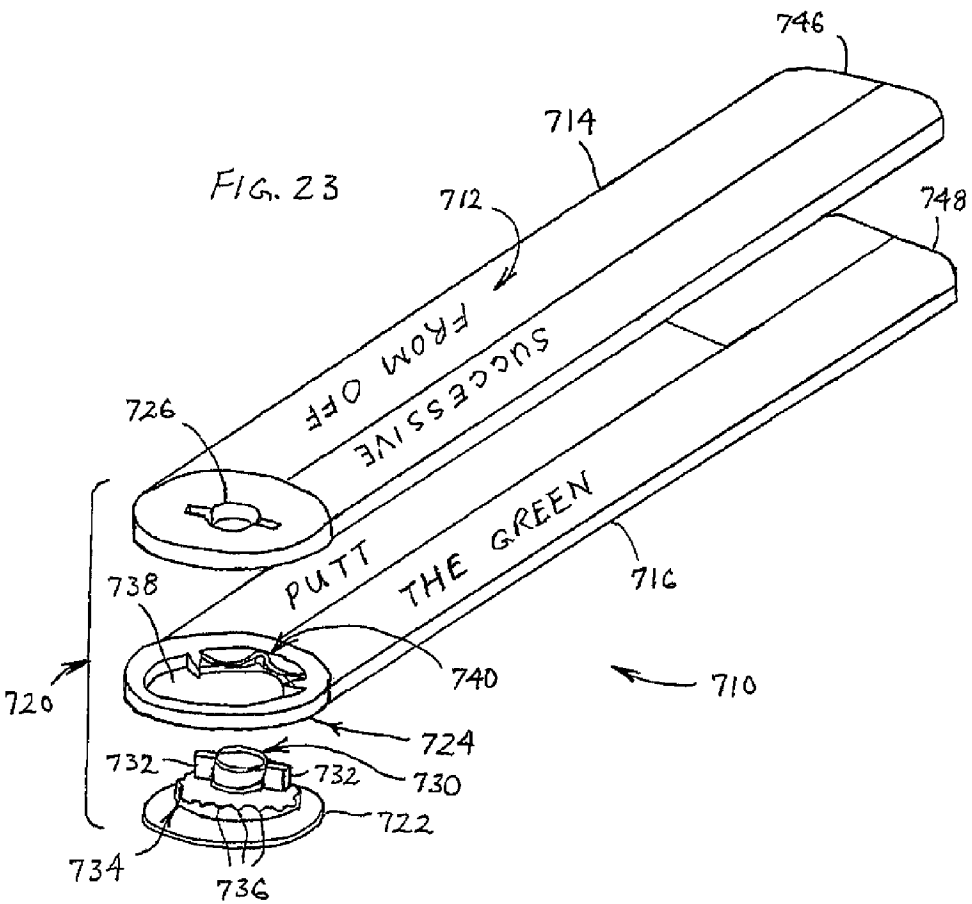
FIG. 23 is a top perspective exploded view of the step lock hinge of the device of FIG. 22.
Figure 22:
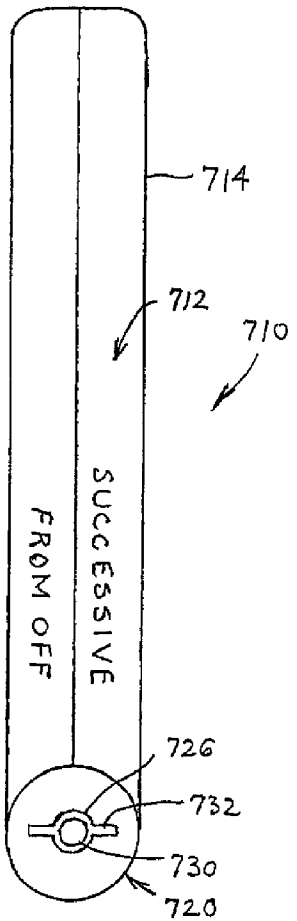
FIG. 22 is a top view of a further example device having two portions and a rotatable step lock hinge.

Still another example of a golf accessory for determining a gimme status of a golf putt is shown in FIGS. 22-23. In this further illustrated example, a device 710 has a first portion 714 and a second portion 716 that are connected by a pivotal step lock hinge 720, and includes areas and/or indicia 712 relating to at least two preselected conditions for gimme status determination. The step lock hinge 720 is formed by the combination of a hinge plate 722, a knuckle 724 in the end of the second portion 716 and a slot 726 in the end of the first portion 714. The hinge plate 722 includes a shaft 730 having keys 732, and a detent rim 734 having a plurality of detents 736. The knuckle 724 includes an aperture 738 along which is formed a detent receiver 740. As with previous examples, there is common starting point for the areas and/or indicia for a gimme status determination of a golf putt, which is at a first end 746 and which extends toward a second end 748.

When assembled, the step lock hinge 720 has the shaft 730 placed through the aperture 738 of the knuckle 724 at the end of the second portion 716 until the hinge plate 722 engages the second portion 716. The shaft 730 and its keys 732 are then located in and connected to the slot 726 in the end of the first portion 714, such as by use of adhesives, welding, press fit, snap fit or other suitable methods of connecting the shaft 730 to the first portion 714. It will be appreciated that the structures need not be a shaft with keys and corresponding slots, but the components should be configured so as to be able to keep the detents 736 in registration with the first portion 714 when assembled.

With the first and second portions 714 and 716 assembled and forming the step lock hinge 720, the first and second portions 714 and 716 may be selectively rotated about the step lock hinge 720, such as from a retracted or folded, closed position, as shown in FIG. 22, to a fully extended or unfolded, open position (not shown). When the first and second portions 714 and 716 are selectively rotated about the step lock hinge 720, the detents 736 successively engage so as to intermesh with the detent receiver 740 in releasable locking positions at rotationally spaced intervals related to the position of the detents 736. It can be appreciated that the locking interval distances will be affected by the size and structure of the detents 736 and the detent receiver 740, such that various relationships and corresponding distances of rotation may be chosen, as desired. The detents 736 also may be configured to limit the range of rotation, such as to limit the rotation to 180 degrees, from a closed position to an open position, or the detents 736 may be configured to allow a full, 360 degrees of rotation, as shown in the example device of FIGS. 22-23. The portions 714 and 716, and components of the step lock hinge 720, such as the detents 736 and the detent receiver 740, may be constructed of plastic, metal or other suitable materials.

Figure 24:
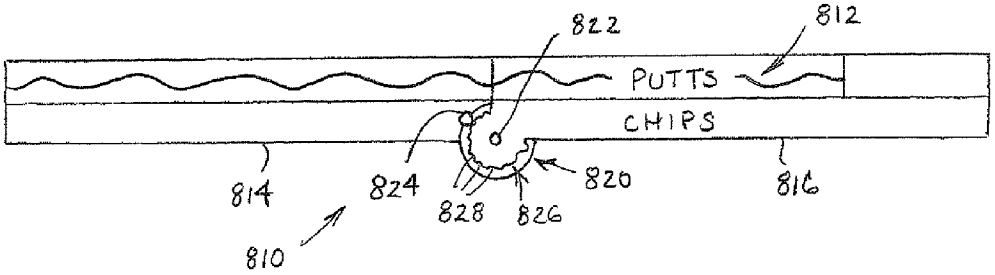
FIG. 24 is a top view of another example foldable device having two portions and an alternative rotatable step lock hinge, in an unfolded position.
Figure 26:
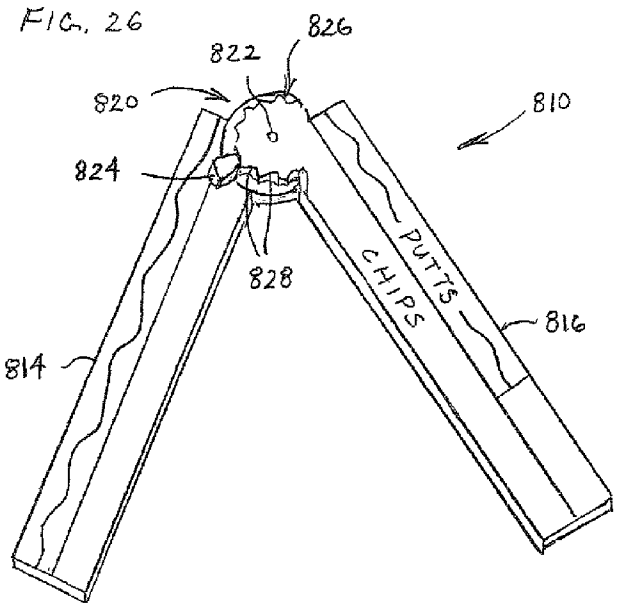
FIG. 26 is a top perspective view of the device of FIG. 24 shown between the folded and unfolded positions.
Figure 25:
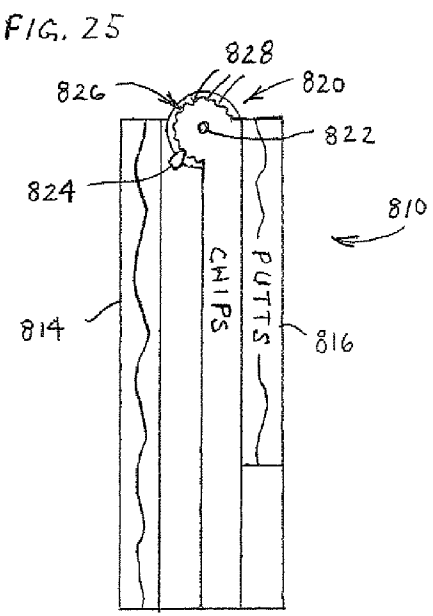
FIG. 25 is a top view of the device of FIG. 25 in a folded position.

A further example of a golf accessory for use in determining a gimme status of a golf putt is shown in FIGS. 24-26. A device 810 has a first portion 814 and a second portion 816 that are connected by another form of a pivotal step lock hinge 820, which could be characterized as an external step lock hinge as opposed to the internal step lock hinge 720 shown in FIG. 23. The step lock hinge 820 is a bit more simple and includes a pivot pin 822, a projection 824 located on the first portion 814, and a detent rim 826 having detents 828 located on the second portion 816. The step lock hinge 820 allows the first and second portions 814 and 816 to remain in any one of several selected positions, such as the extended or unfolded, open position shown in FIG. 24, the completely retracted or folded, closed position shown in FIG. 25, or the partially folded position shown in FIG. 26.

It will be appreciated that the device 810 is releasably locked in each rotational position due to the engagement between the projection 824 and the detents 828 on the detent rim 826. Similarly to the above-discussed example in FIGS. 22-23, with respect to rotation intervals per detent, this may be chosen and accomplished via the configuration of the projection and respective detents. However, in this example, the range of rotation of the portions 814 and 816 is limited to the open position shown in FIG. 24 and the closed position shown in FIG. 25, because the portions 814, 816 do not overlap and instead abut each other in a parallel relationship when retracted or folded to the closed position. As with the preceding examples, the portions 814 and 816 include areas and/or indicia 812 relating to at least two preselected conditions for performing a gimme status determination. Also, the portions 814 and 816 may be constructed of relatively rigid plastic, with the projection 824 and detents 828 integrally molded into the portions, or may be constructed of other suitable materials.

Figure 27:
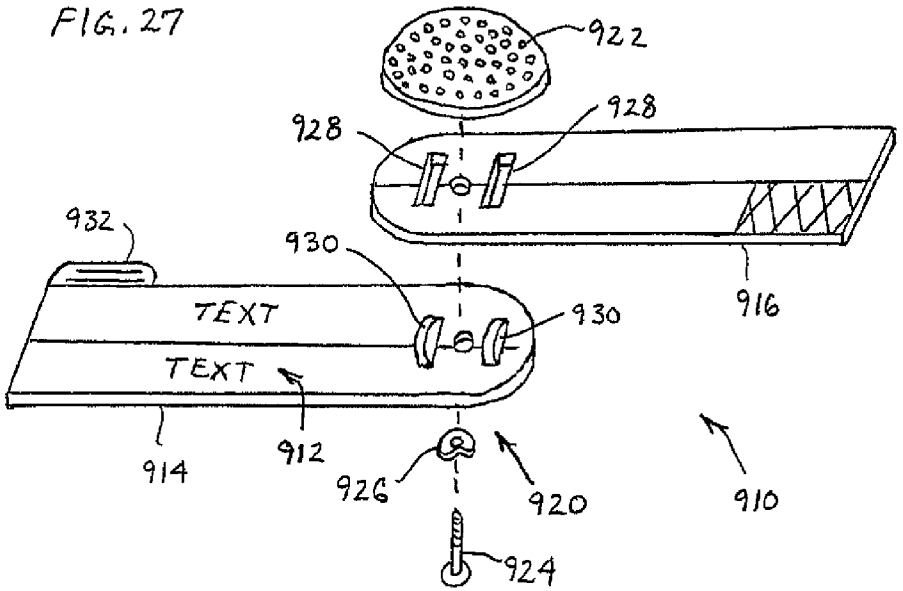
FIG. 27 is a top exploded perspective view of a further example foldable device having two portions and spring biased hinge in an unfolded position.
Figure 28:
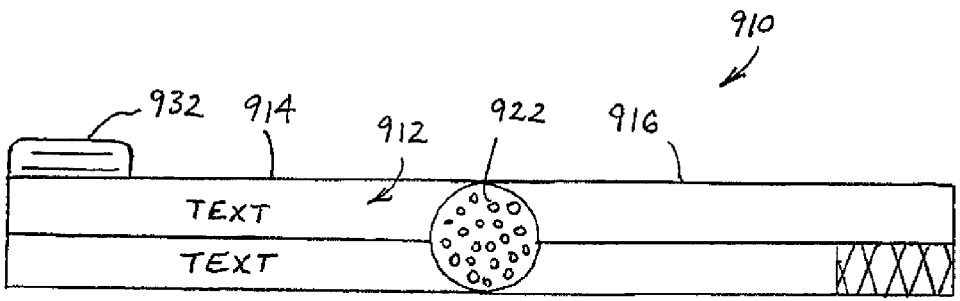
FIG. 28 is a top view of the device of FIG. 27 in an unfolded position.
Figure 29:
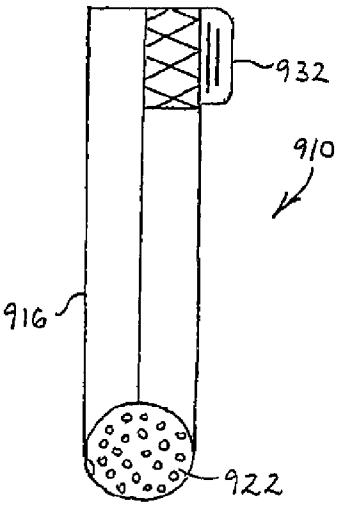
FIG. 29 is a top view of the device of FIG. 27 in a folded position.

Another example of a golf accessory for determining a gimme status of a golf putt is shown in FIGS. 27-29. A device 910 includes first portion 914 and second portion 916 that are pivotally connected by a two position releasable lock 920. The portions 914 and 916 may be constructed of relatively rigid plastic, metal or other suitable materials. The releasable lock 920 permits an extended or unfolded, open position shown in FIG. 28, and a retracted or folded, closed position shown in FIG. 29. The releasable lock 920 includes an optional button 922 that may be shaped as desired and is shown in FIGS. 27-29 as resembling a portion of a golf ball. The button 922 is positioned above the top surface of the second portion 916 and is attached to a pivot pin 924, such as by threaded engagement. The pivot pin 924 goes through a hole in each of the portions 914 and 916, and has a spring 926 between the bottom surface of the first portion 914 and the head of the pivot pin 924. The spring 926, in the form of a wave washer, biases the portions 914 and 916 together and against the button 922.

The second portion 916 includes a pair of parallel slots 928 and the first portion 914 includes a pair of corresponding elongated projections 930 that are received in the slots 928 whether the portions 914 and 916 are in a folded or unfolded position. As one of the portions is rotated relative to the other, the ramped ends of the projections 930 permit the projections 930 to ride up and out of the slots 928 so that when one of the portions is rotated 180 degrees relative to the other portion, the projections 930 will automatically exit the slots 928 as the portion is initially rotated and then re-engage the slots 928 to releasably lock as the portions achieve the opposed position. To enhance the ability to grasp and rotate one portion relative to the other, the first portion 914 includes an optional grip 932 that extends laterally from the first portion 914. It will be appreciated that if the button 922 is not included, the pivot pin 924 may instead be connected directly to the second portion 916. It will be appreciated that the portions 914 and 916 include areas and/or indicia 912 relating to at least two preselected conditions for performing a gimme status determination of a golf putt.

Figure 31:
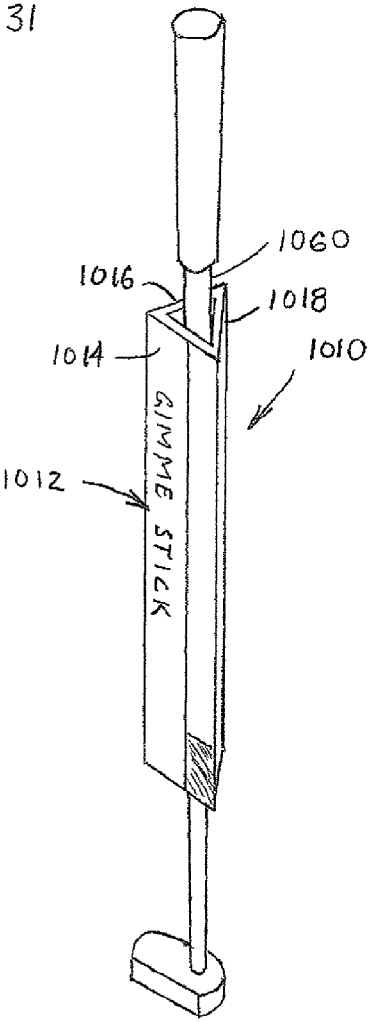
FIG. 31 is a perspective view of the device of FIG. 30 in a folded position around the shaft of a golf club.
Figure 30:
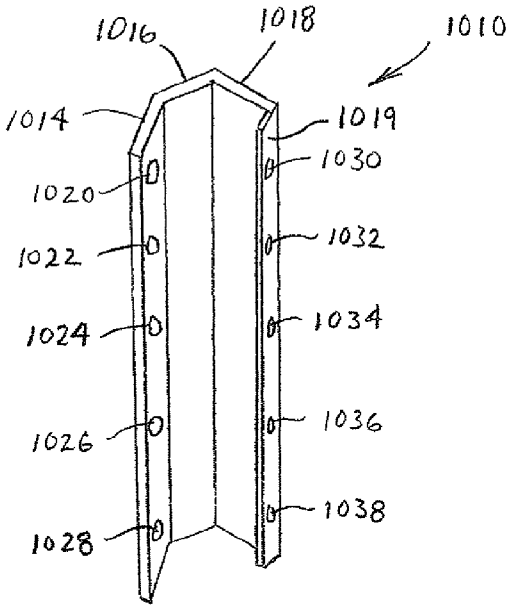
FIG. 30 is a perspective view of another example device having three portions that are able to be connected to a shaft of a golf club, shown in an unfolded position.

Still another example of a golf accessory for determining a gimme status of a golf putt is shown in FIG. 30-31. An elongated device 1010 includes a foldable soft structure having connected first, second and third flat portions 1014, 1016, and 1018, having areas and/or bearing indicia 1012 relating to at least two preselected conditions for use in a gimme status determination of a golf putt on an exterior surface of at least one of the three portions, and a connector flap 1019 extending from the third portion 1018. The first portion 1014 includes magnetic connector elements 1020, 1022, 1024, 1026, and 1028, while the flap 1019 extending from the third portion 1018 includes corresponding magnetic connector elements 1030, 1032, 1034, 1036, and 1038. The respective magnetic connector elements serve to releasably lock the device 1010 around an object, such as a golf club 1060, as shown in FIG. 31, or a golf cart handle. The portions 1014, 1016 and 1018 may be constructed of similar materials to those described with respect to the above-described examples, but hinged, such as by use of a living hinge with plastic portions, or the device 1010 may include fabric covered members that form portions 1014, 1016 and 1018. It will be appreciated that various types of releasable connector elements may be used, such as snaps or buttons, or elongated connector elements such as Velcro® or a zipper.

Figure 32:
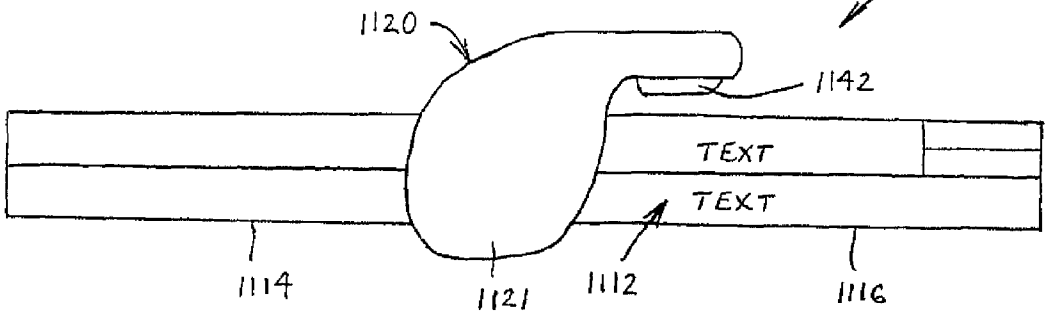
FIG. 32 is a top view of a further example foldable device having two portions and a release handle, with the device shown in an unfolded position.
Figure 33:
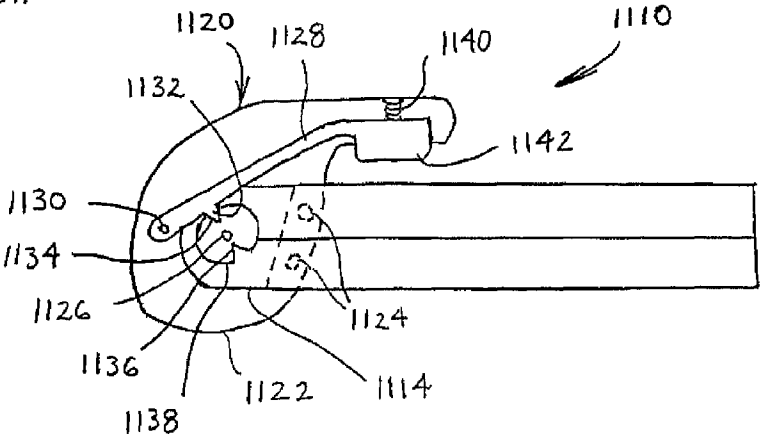
FIG. 33 is a top view of the device of FIG. 32 with a handle cover removed and with the device in a closed position.

Another example of a golf accessory for determining a gimme status of a golf putt is shown in FIG. 32-33. A device 1110 has a first portion 1114 pivotally connected to a second portion 1116 via a releasable locking handle assembly 1120. The portions 1114 and 1116 may be constructed of similar materials to those described with respect to the above-described examples, and have areas or indicia 1112 relating to at least two preselected conditions for use in a gimme status determination of a golf putt on at least one surface. As is best seen in FIG. 33, with a first handle assembly cover 1121 removed, one can see that the handle assembly 1120 has a second cover 1122 that is fixedly connected to the second portion 1116, such as by fasteners 1124 (shown in phantom because it is directly beneath the first portion 1114), while the first portion 1114 is pivotally connected to the handle assembly 1120 by a pivot pin 1126. The handle assembly 1120 further includes a lever 1128 that is pivotally mounted to the second cover 1122 by a pivot pin 1130 and includes a projection 1132. Depending on the pivotal position of the first portion 1114 relative to the second portion 1116, the projection 1132 fits in one of the respective notches 1134, 1136 in a circular disc 1138 that is affixed to the end of the first portion 1114. The lever 1128 is biased by a spring 1140 to automatically force the projection 1132 into one of the notches 1134, 1136 when aligned with the respective notch. The lever 1128 has a gripping end 1142 that when squeezed into the handle cover 1122, the projection 1132 is withdrawn from one of the notches 1134, 1136, permitting pivotal movement of the disc 1138 at the end of the first portion 1114, which allows rotation of the first portion 1114 relative to the second portion 1116.

In this example, the handle assembly 1120 is configured to fit securely around a club partition in a golf bag, such as is shown in FIG. 11, so that the device 1110 may be stowed when not in use, yet accessed easily. FIG. 32 shows device 1110 in the extended or unfolded, open position, when the projection 1132 on the lever 1128 would be in the notch 1136 on the first portion 1114. FIG. 33 shows the device 1110 in a retracted or folded, closed position, with the projection 1132 in the notch 1134. When the gripping end 1140 of the lever 1128 is depressed, the lever 1128 moves against the spring 1140 and the projection 1132 is withdrawn, permitting pivotal movement of the first portion 1114.

Figure 34:
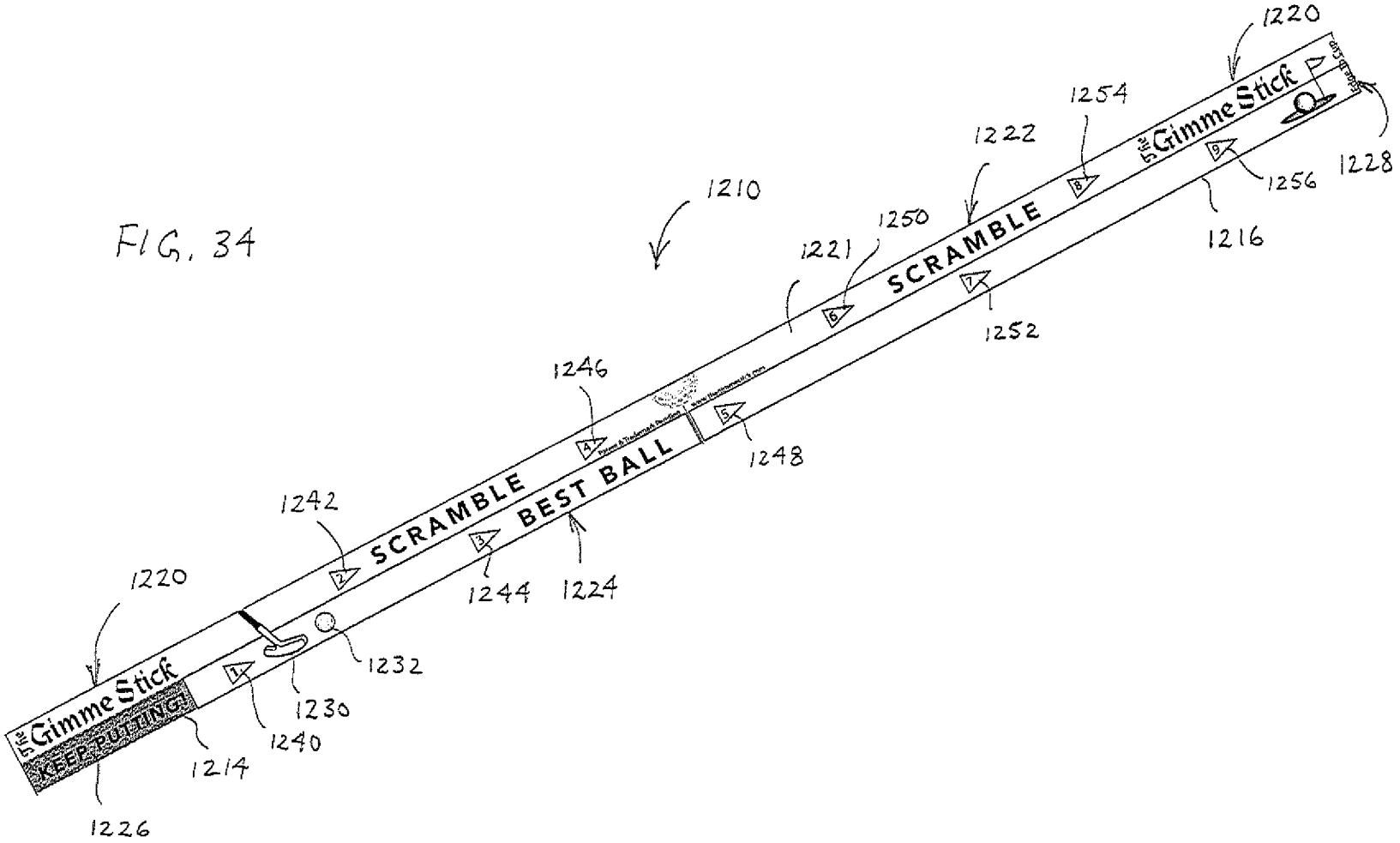
FIG. 34 is a top view of the device of FIG. 24, depicting indicia for determining a gimme putt on the golf course and for playing a gimme game on a practice putting green.

FIG. 34 is an example device 1210 for determining gimme putts, which may be foldable and most closely resembles the device of FIG. 24, but also is similar to the devices shown in FIGS. 1, 7, 9, 12, 15 and 19. Indeed the example text on the device 1210 could be employed on any of the other above-described example devices. However, the device 1210 in FIG. 34 has indicia that includes text and drawings to be used in gimme determinations during regular golf play, as well as for a gimme game on a practice putting green. In this example, the device has first and second portions 1214 and 1216, and includes regions 1220 on the top side 1221 of the device and proximate the respective ends of portions 1214 and 1216 for applying the product name, advertising or other text or graphics. The top side 1221 also is divided into upper and lower halves with the event types, "Scramble" 1222, and "Best Ball" 1224, which represent a sample methodology to determine the appropriate segment to use in regular play, located within the respective upper and lower halves. In this example, a shaded region 1226 on the lower half of the first portion 1214 includes the text "KEEP PUTTING", to disallow a gimme for the prescribed condition, e.g., the event type, "Best Ball" 1224, that is displayed on the lower half of the device 1210.

The text 1228 along the vertical edge of the second portion 1216 indicates which end of the device 1210 is to be placed against the edge of the golf hole when making a gimme determination. Depictions of a putter 1230, a golf ball 1232, and a golf ball centered in a hole with a miniaturized flag 1234 also are intended to influence correct directional use of the device 1210 and are meant to add aesthetic value to the device.

The numbered flags "1" 1240, "2" 1242, "3" 1244, "4" 1246, "5" 1248, "6" 1250, "7" 1252, "8" 1254, and "9" 1256, are placed along the device at equally spaced and alternating upper and lower half intervals in left to right ascending order. Each numbered flag represents a point value to be used for a gimme game on a practice putting green. The game proceeds with the players putting toward successive practice targets, such as putting from one practice green hole or other marker, normally numbered 1, to a subsequent practice green hole or other marker, normally numbered 2, and continuing in this normal successive sequence until they have putted to all of the respective practice targets. The players may elect to complete more than one round to these markers and may elect to determine their own sequence around the practice putting green. Points are awarded based on the proximity of each player's first putt to the intended practice green marker. The closer the ball comes to rest near the intended hole, the higher the point value awarded to the player for that stroke, as indicated by the respective number within the numbered flags, 1240-1256. Cumulative point totals are kept as the players proceed around the practice green and the player with the highest accumulated point total wins the game. There also can be different game formats, such as for example, using the golf course score card and playing rounds of 9 or 18 practice holes; playing a 72-hole tournament involving multiple groups with a cut line after 36 holes for the players with the best cumulative point totals; or simply playing first one to 100 points.

Accordingly, in a further aspect, the disclosure provides a golf accessory that includes an elongated device having areas relating to at least two preselected conditions by which a gimme status of a putt is determined and having numbered flags to be used in a gimme game on a practice putting green. The game is intended to provide golfers with a way to have fun on the practice green and to develop the lag putting skills necessary to earn more short putt gimme concessions during regular play on the course.

The example devices of the present disclosure provide an easy to use but accurate means for determining the gimme status of a golf putt when a golf ball is located near a hole on a putting surface, such as a golf green. The device can be handled by one person and utilized in a simple and effective method in a considerably quicker manner than attempting to measure the distance with a measuring tape having unit increments and having to then perform calculations or reference some other instructions, or by using a flagstick or a putter. It does not require leaving a flagstick in a hole, and as such, does not require modification of other rules relating to proper use of a flagstick. The devices and their methods of use provide consistent results while also minimizing traffic around the hole or destructive actions such as may occur when placing a putter head within the hole. This, in turn, is more beneficial to the condition of the hole and turf around the hole than using the "inside the leather" technique.

The device is not limited in its construction or application to the details of the examples described or illustrated herein. The device may be constructed in various ways and of one or more different materials, and is capable of being practiced and carried out in various ways. Also, it is to be understood, that the phraseology and terminology employed herein are for the purpose of description and should not be regarded as limiting.

Further, the purpose of the Abstract is to enable the U.S. Patent and Trademark Office and the public or practitioners in the art generally who may not be familiar with patents or legal terms or phraseology, to determine quickly from a cursory inspection the nature of the disclosure of the application. Accordingly, the Abstract is neither intended to define the disclosure or the application, nor is it intended to be limiting as to the scope of the disclosure any way.

With respect to the above description, it should be realized that other dimensional relationships may be chosen and the device may be carried out in other ways than those set forth herein without departing from the spirit and essential characteristics of the disclosure. The present embodiments are, therefore, to be considered in all respects as illustrative and not restrictive and all changes coming within the meaning and equivalency range of the appended claims are intended to be embraced therein.

I claim:

1. A golf accessory comprising: a device having at least one substantially rigid elongated portion and having at least two areas along the length of the device corresponding respectively to at least two preselected conditions by which a gimme status of a golf putt is to be determined, wherein when a first end of the device is located adjacent a golf hole and the device is extended toward a ball to be putted a first of the at least two preselected areas extends from the first end of the device to an opposed second end of the device and defines a maximum length that is associated with a first of the at least two preselected conditions, and a second of the at least two preselected areas extends from the first end of the device toward the second end of the device and defines a length shorter than the first of the at least two preselected areas and that is associated with a second of the at least two preselected conditions, wherein the two preselected conditions relate to a golf event format being played, a likely score that would be attained if the putt were to be successful, or a stroke played that resulted in a present position of the ball to be putted, and wherein a gimme is awarded when the ball to be putted meets one of the at least two conditions and is within the length of the area associated with said condition that is met.

2. The golf accessory of claim 1, wherein the at least two preselected conditions relating to the golf event format being played are listed in indicia as Scramble and Best Ball on the respective at least two different areas.

3. The golf accessory of claim 1, wherein the at least two preselected conditions relating to the golf event format being played are displayed lengthwise on respective upper and lower areas along the edges of a top side of the device.

4. The golf accessory of claim 1, wherein the device further comprises indicia on at least one surface relating to at least one of the at least two preselected conditions.

5. The golf accessory of claim 4, wherein the indicia includes demarcation of at least two sections that relate to the at least two preselected conditions.

6. The golf accessory of claim 5 wherein the at least two portions are connected telescopically.

7. The golf accessory of claim 1, further comprising at least two portions that are connected.

8. The golf accessory of claim 7, wherein the at least two portions are connected pivotally.

9. The golf accessory of claim 7, wherein the device is foldable.

10. A golf accessory comprising: a device having at least one substantially rigid elongated portion and having at least two areas along the length of the device bearing indicia corresponding respectively to at least two preselected conditions by which a gimme status of a golf putt is to be determined, wherein when a first end of the device is located adjacent a golf hole and the device is extended toward a ball to be putted a first of the at least two preselected areas extends from the first end of the device to an opposed second end of the device and defines a maximum length that is associated with a first of the at least two preselected conditions, and a second of the at least two preselected areas extends from the first end of the device toward the second end of the device and defines a length shorter than the first of the at least two preselected areas and that is associated with a second of the at least two preselected conditions, and wherein a gimme is awarded when the ball to be putted meets one of the at least two conditions and is within the length of the area associated with said condition that is met, and further comprising indicia relating to a practice putting game.

11. The golf accessory of claim 10, further comprising at least two portions that are connected.

12. The golf accessory of claim 11, wherein the at least two portions are connected pivotally.

13. The golf accessory of claim 11, wherein the at least two portions are connected telescopically.

14. The golf accessory of claim 10, wherein the indicia for the practice putting game comprises at least two markings that provide associated point values.

15. The golf accessory of claim 14, wherein the at least two markings include renderings of flags with point values indicated within the respective flags.

* * * * *